US008170870B2

(12) United States Patent
Kemmochi et al.

(10) Patent No.: US 8,170,870 B2
(45) Date of Patent: May 1, 2012

(54) APPARATUS FOR AND PROGRAM OF PROCESSING AUDIO SIGNAL

(75) Inventors: Hideki Kemmochi, Shizuoka (JP); Jordi Bonada, Barcelona (ES)

(73) Assignee: Yamaha Corporation, Hamamatsu-shi (JP)

( * ) Notice: Subject to any disclaimer, the term of this patent is extended or adjusted under 35 U.S.C. 154(b) by 846 days.

(21) Appl. No.: 11/273,749

(22) Filed: Nov. 14, 2005

(65) Prior Publication Data

US 2006/0111903 A1 May 25, 2006

(30) Foreign Application Priority Data

Nov. 19, 2004 (JP) ..... 2004-336224

(51) Int. Cl.
*G10L 11/04* (2006.01)
*G10L 13/00* (2006.01)
*G10H 1/06* (2006.01)

(52) U.S. Cl. ..... 704/207; 704/258; 84/622

(58) Field of Classification Search ..... 704/211, 704/240, 244
See application file for complete search history.

(56) References Cited

U.S. PATENT DOCUMENTS 5,022,304 A * 6/1991 Masaki ..... 84/607
5,223,656 A * 6/1993 Higashi ..... 84/661
5,381,514 A 1/1995 Aso
5,763,803 A 6/1998 Hoshiani
5,998,724 A * 12/1999 Takeuchi et al. ..... 84/622
6,490,562 B1 * 12/2002 Kamai et al. ..... 704/258
6,606,388 B1 * 8/2003 Townsend et al. ..... 381/17
6,931,373 B1 * 8/2005 Bhaskar et al. ..... 704/230
6,944,589 B2 * 9/2005 Yoshioka et al. ..... 704/209
6,992,245 B2 * 1/2006 Kenmochi et al. ..... 84/622
2003/0009336 A1 1/2003 Kenmochi et al.
2003/0059063 A1 * 3/2003 Inoue ..... 381/104
2003/0220787 A1 * 11/2003 Svensson et al. ..... 704/207
2003/0221542 A1 * 12/2003 Kenmochi et al. ..... 84/616
2003/0229490 A1 * 12/2003 Etter ..... 704/211
2004/0136546 A1 7/2004 Oh

FOREIGN PATENT DOCUMENTS

JP 2002-202790 7/2002

* cited by examiner

*Primary Examiner* — Richemond Dorvil
*Assistant Examiner* — Olujimi Adesanya
(74) *Attorney, Agent, or Firm* — Morrison & Foerster LLP

(57) ABSTRACT

In an audio signal processing apparatus, a generation section generates an audio signal representing a voice. A distribution section distributes the audio signal generated by the generation section to a first channel and a second channel, respectively. A delay section delays the audio signal of the first channel relative to the audio signal of the second channel for creating a phase difference between the audio signal of the first channel and the audio signal of the second channel such that the created phase difference has a duration corresponding to either an added value of a first duration which is approximately one half of a period of the audio signal generated by the generation section and a second duration which is set shorter than the first duration, or a difference value of the first duration and the second duration. An addition section adds the audio signal of the first channel and the audio signal of the second channel with one another, between which the phase difference is created by the delay section, and outputs the added audio signal which represents natural voice with various characteristics.

11 Claims, 13 Drawing Sheets

APPARATUS FOR AND PROGRAM OF PROCESSING AUDIO SIGNAL

BACKGROUND OF THE INVENTION

1. Technical Field

The present invention pertains to a technical field of processing an audio signal, and particularly relates to a technology of adding effects to the audio signal to output a resultant signal.

2. Background Art

There have been conventionally proposed various kinds of technologies for generating a voice with desired characteristics. For example, Japanese Unexamined Patent Publication (Kokai) No. 2002-202790 (paragraphs 0049 and 0050) discloses a technology for synthesizing the so-called husky voice. According to this technology, by performing an SMS (Spectral Modeling Synthesis) analysis to the audio signal presenting a specific voice on frame basis, a harmonic component and a non-harmonic component are extracted as data of a frequency domain, for generation of a voice segment (a phoneme or phoneme chain). When the voice is now actually synthesized, after the voice segments corresponding to a desired vocal sound (for example, lyrics) are mutually linked, addition of the harmonic component and the non-harmonic component is implemented and then, a reverse FFT processing is performed to a result of this addition for every frame, thereby generating the audio signal. According to this configuration, a feature of the nonharmonic component added to the harmonic component is appropriately changed for permitting it to generate the audio signal with the desired characteristics such as the husky voice.

Incidentally, as for an actual human voice, a period of the waveform may irregularly change every moment. This tendency is remarkable particularly in individual voices, such as a rough or harsh voice (the so-called croaky voice). According to the conventional technology described above, however, since the voice is synthesized by the processing in the frequency domain for each frame, the period of this synthesized audio signal will be inevitably kept constant in each frame. As a result, a problem is encountered such that the voice generated by using this technology tends to result in a mechanical and unnatural voice due to fewer changes in period than that of the actual human voice. It should be noted that the case of synthesizing the voice by the link of the voice segments is described as an example here, but a like problem may also be encountered in a technology of changing the characteristics of the voice that a user sounds and of outputting a resultant voice. As will be understood, also in this technology, the audio signal supplied from a sound capturing apparatus, such as a microphone, is converted into the data of the frequency domain for every frame, and the audio signal of a time domain is generated after properly changing the frequency characteristics for every frame, so that the period of the voice in one frame will be kept constant. Thus, according to even this technology, similarly to that disclosed in Japanese Unexamined Patent Publication (Kokai) No. 2002-202790, there is a limit for generating a natural voice close to the actual human voice.

SUMMARY OF THE INVENTION

The present invention is made in view of such a situation as described above, and aims at generating the natural voice with various characteristics.

In order to solve the problem, a first feature of an audio signal processing apparatus according to the present invention includes a generation section for generating an audio signal representing a voice, a distribution section for distributing the audio signal generated by the generation section to a first channel and a second channel, a delay section for delaying the audio signal of the first channel relative to the audio signal of the second channel so that a phase difference between the audio signal of the first channel and the audio signal of the second channel may have a duration corresponding to an added value or a difference value of a first duration which is approximately one-half of a period of the audio signal generated by the generation section, and a second duration which is set shorter than the first duration (more specifically, shorter than approximately one-half of the first duration), and an addition section for adding the audio signals of the first channel and the second channel, to which the phase difference is given by the delay section, to output an added audio signal. Incidentally, a specific example of this configuration will be described later as a first embodiment.

According to this configuration, since the audio signal of the first channel is delayed relative to the audio signal of the second channel so that the phase difference between the audio signals branched to the respective channels may be the phase difference corresponding to the added value or the difference value between the first duration which is approximately one-half of the period of the audio signal generated by the generation section, and the second duration which is set shorter than the first duration, the audio signal obtained by adding the audio signals of the respective channels result in a waveform in which the period is changed for every single waveform. Thus, according to the present invention, a natural voice which imitates actual human being's hoarse voice and rough or harsh voice can be generated.

It should be appreciated that the delay section according to the present invention may be achieved by one delay section (for example, refer to FIG. 12), or may be achieved by a plurality of delay sections corresponding to the respective first duration and second duration. In the latter configuration, the delay section includes a first delay section (for example, a delay section 31 in FIG. 4) for delaying the audio signal of the first channel relative to the audio signal of the second channel by the first duration that a delay amount calculation section calculates, and a second delay section (for example, a delay section 32 in FIG. 4) for delaying the audio signal of the first channel relative to the audio signal of the second channel by the second duration set shorter than the first duration.

According to a preferred aspect of the present invention, the audio signal processing apparatus further includes an amplitude determination section for determining an amplitude of the audio signal generated by the generation section, wherein the delay section changes the second duration on the basis of the amplitude determined by the amplitude determination section. According to this aspect, the second duration is changed on the basis of the amplitude of the audio signal generated by the generation section, to thereby accurately reproduce the characteristics of the actual voice. For example, if the second duration is made longer as the amplitude of the audio signal generated by the generation section becomes larger, (namely, if the second duration is made shorter as the amplitude of the audio signal generated by the generation section is smaller), it is possible to realize a tendency of the voice that the louder the voice volume becomes, the more remarkable the characteristics as the rough or harsh voice. A specific example of this aspect will be described later as a second aspect of the first embodiment (FIG. 5).

According to still another aspect, the audio signal processing apparatus further includes a control section that receives data for specifying the second duration and sets the second duration specified by this data in the delay section. According to this aspect, by appropriately selecting details of the data, the characteristics as the rough or harsh voice can be automatically changed at an appropriate timing. A specific example of this aspect will be described later as a third aspect of the first embodiment (FIG. 7).

According to still another aspect, the audio signal processing apparatus further includes an amplification section for adjusting a gain ratio between the audio signal of the first channel and the audio signal of the second channel, wherein the addition section adds the audio signals of the first channel and the second channel after adjustment thereof by the amplification section to output an added audio signal. According to this aspect, by appropriately adjusting the gain ratio between the audio signal of the first channel and the audio signal of the second channel, the rough or harsh voice with desired characteristics can be outputted. Incidentally, a method of selecting the gain set in the amplification section may be arbitrarily employed. For example, it may be configured in such ways that the specified gain is set in the amplification section by an input device due to operation by the user, or that the amplitude determination section for determining the amplitude of the audio signal generated by the generation section sets the gain of the amplification section according to this determined amplitude.

A second feature of an audio signal processing apparatus according to the present invention includes a generation section for generating an audio signal representing a voice, a distribution section for distributing the audio signal generated by the generation section to a first channel and a second channel, a delay section for delaying the audio signal of the first channel relative to the audio signal of the second channel so that a phase difference between the audio signal of the first channel and the audio signal of the second channel have a duration corresponding to approximately one-half of a period of the audio signal generated by the generation section, an amplification section for changing an amplitude of the audio signal of the first channel with time, and an addition section for adding the audio signals of the first channel and the second channel after being subjected to the processing by the delay section and the amplification section, to output an added audio signal. Incidentally, a specific example of this configuration will be described later as a second embodiment.

According to this configuration, the amplitude of the audio signal of the first channel which is delayed relative to the audio signal of the second channel by the duration changes with time. For example, the amplitude of the audio signal of the first channel is increased with lapse of time, so that it is possible to generate a natural voice which is gradually shifted from an original pitch of the audio signal generated by the generation section to a target pitch higher than that by two times with the time lapse (namely, higher pitch by one octave). It should here be noted that the pitch in the present invention means a fundamental frequency of the voice.

In another aspect of the audio signal processing apparatus having the second feature, there is further provided an amplitude determination section for determining an amplitude of the audio signal generated by the generation section, wherein the amplification section changes the amplitude of the audio signal of the first channel depending on the amplitude determined by the amplitude determination section. According to this aspect, when the generation section generates the audio signal, which is gradually increased in its amplitude from a given point of time, it is possible to generate such a voice that gradually approaches to a voice with a higher pitch by one octave from an initial pitch (a pitch of the audio signal that is generated by the generation section). A specific example of this aspect will be described later as a first example of the second embodiment (refer to FIG. 8).

It should be understood that the configuration for setting the gain of the amplification section is not limited to this. For example, according to another aspect, there is provided a control section that receives data for specifying the gain of the amplification section and sets the gain specified by this data for the amplification section. In this aspect, if the control section increases the gain specified in the amplification section with the time lapse on the basis of the data, it is possible to generate such a natural voice that the voice gradually shifts from the initial pitch to the pitch higher than that by one octave. A specific example of this aspect will be described later as a second aspect of the second embodiment (FIG. 10).

According to a specific aspect of the audio signal processing apparatus having the first and second features, there is provided a delay amount calculation section for specifying a period (period T0 in FIG. 3) corresponding to a target pitch (pitch P0 in FIG. 3) as the first duration in the delay section, wherein the generation section generates an audio signal of a pitch which is approximately one-half of the target pitch. According to this aspect, a voice corresponding to the target pitch can be generated. It should be understood that a method of selecting the target pitch and a method of generating the audio signal of the pitch by the generation section might be arbitrarily employed. For example, there may be employed such a configuration that the generation section receives data for specifying the target pitch to synthesize the audio signal of the pitch which is approximately one-half of a pitch specified by this data (pitch Pa in FIG. 3) by the link of the voice segments, and the delay amount calculation section calculates a period corresponding to the pitch specified by the data as the first duration (the first and the second embodiments). Meanwhile, in a configuration including a pitch detection section for detecting the pitch of the audio signal supplied from a sound capturing apparatus as the target pitch, the delay amount calculation section calculates a period corresponding to the pitch detected by the pitch detection section as the first duration, and the generation section converts the pitch of the audio signal supplied from the sound capturing apparatus into a pitch which is approximately one-half of the pitch detected by the pitch detection section (for example, refer to FIG. 14). A natural voice with various characteristics can be generated in any of the described configurations.

Incidentally, in the audio signal processing apparatus according to the present invention, the first feature and the second feature may be appropriately combined together. For example, the delay section of the audio signal processing apparatus according to the second feature may be used for delaying the audio signal of the first channel relative to the audio signal of the second channel so that a phase difference between the audio signal of the first channel and the audio signal of the second channel may have a duration corresponding to an added value or a difference value between the first duration and the second duration which is set shorter than the first duration. Moreover, the audio signal processing apparatus according to the present invention is defined to have such a configuration that the audio signal is distributed to the first channel and the second channel, but another configuration in which the audio signal generated by the generation section is distributed to more channels may be included in the scope of the present invention, if one channel among them is considered as the first channel and the other channel is considered as the second channel.

The audio signal processing apparatus according to the present invention may be practically realized by not only hardware, such as a DSP (Digital Signal Processor) dedicated to the audio signal processing, but also collaboration between a computer, such as a personal computer, and software. A program according to a first feature of the present invention is provided with instructions capable of allowing a computer to execute a process of generation for generating an audio signal representing a voice, a process of delay for delaying an audio signal of a first channel relative to an audio signal of a second channel so that a phase difference between the audio signals of the first channel and the audio signal of the second channel, to which the audio signal generated by the generation processing is distributed, may have a duration corresponding to an added value or a difference value between a first duration which is approximately one-half of a period of the audio signal generated by the generation process and a second duration which is set shorter than the first duration, and addition process for adding the audio signals of the first channel and the second channel to which the phase difference is given by the delay processing to output an added audio signal.

Moreover, a program according to a second feature of the present invention is provided with instructions capable of allowing a computer to execute process of generation for generating an audio signal representing a voice, a process of delay for delaying an audio signal of a first channel relative to an audio signal of a second channel so that a phase difference between the audio signal of the first channel and the audio signal of the second channel, to which the audio signal generated by the generation process is distributed, may have a duration corresponding to approximately one-half of a period of the audio signal generated by the generation processing, a process of amplification for changing an amplitude of the audio signal of the first channel with time, and a process of addition for adding the audio signal of the first channel subjected to the delay process and the amplification process and the audio signal of the second channel with each other to thereby output an added audio signal. According also to these programs, a function and an effect identical with those in the audio signal processing apparatus according to the first and the second features of the present invention may be obtained. Incidentally, the program according to the present invention is not only provided for a user in a form stored in computer readable recording media, such as CD-ROM to be installed in the computer, but also supplied from a server apparatus in a form of distribution through a network to be installed in the computer.

Additionally, the present invention is also defined as a method of processing a voice. Namely, an audio signal processing method according to a first feature of the present invention includes a generation step for generating an audio signal representing a voice, a delay step for delaying an audio signal of a first channel relative to an audio signal of a second channel so that a phase difference between the audio signals of the first channel and the second channel, to which the audio signal generated by the generation step is distributed, may have a duration corresponding to an added value or a difference value between a first duration which is approximately one-half of a period of the audio signal generated by the generation step and a second duration which is set shorter than the first duration, an addition step for adding the audio signals of the first channel and the second channel to which the phase difference is given by the delay step to output an added audio signal.

Moreover, an audio signal processing method according to a second feature includes a generation step of generating an audio signal representing a voice, a delay step of delaying an audio signal of a first channel relative to an audio signal of a second channel so that a phase difference between the audio signals of the first channel and the second channel, to which the audio signal generated by the generation step is distributed, may have a duration which is approximately one-half of a period of the audio signal generated by the generation step, an amplification step of changing an amplitude of the audio signal of the first channel with time, and an addition step of adding the audio signal of the first channel subjected to the delay step and the amplification step and the audio signal of the second channel with each other to thereby output an added audio signal.

As described above, in accordance with the present invention, a natural voice with various characteristics can be generated.

DETAILED DESCRIPTION OF THE INVENTION

Figure 1:
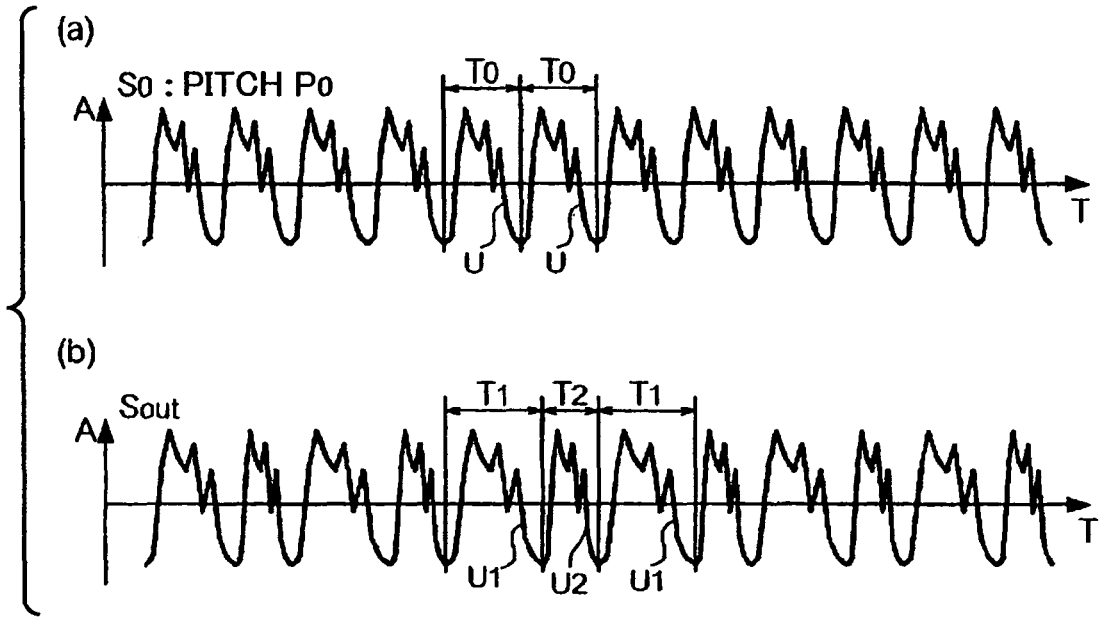
FIG. 1 is a chart showing an audio signal waveform representing a rough or harsh voice.

An audio signal processing apparatus in accordance with the present invention is appropriately utilized for generating various voices, such as a rough or harsh voice, in particular. Now, prior to description of a configuration of the audio signal processing apparatus in accordance with the present invention, an audio signal waveform for expressing the rough or harsh voice will be explained. A portion (b) of FIG. 1 is a chart showing a waveform on a time base T of an audio signal Sout expressing the rough or harsh voice. An ordinate of FIG.

1 represents an amplitude A. Moreover, in a portion (a) of FIG. 1, an audio signal S0 expressing an articulate voice (the so-called clear voice) without hoarseness and dullness is represented together for the sake of comparison. As shown in the portion (a) of FIG. 1, the waveform of the audio signal S0 has a shape in which waveforms U used as a unit of repetition (hereinafter, referred to as "unit waveform") are arranged at even intervals on the time base. In this audio signal S0, a period T0 of each unit waveform U is almost the same. As opposed to this, as shown in the portion (b) of FIG. 1, a waveform of the audio signal Sout expressing the rough or harsh voice has a shape in which two types of unit waveforms U (U1 and U2) whose periods are different from each other are alternately arranged on the time base. For example, in the portion (b) of FIG. 1, a period T1 of the unit waveform U1 is longer than a period T2 of the unit waveform U2 that follows immediately after that, and further this period T2 is shorter than the period T1 of the unit waveform U1 immediately after the unit waveform U2.

A: First Embodiment

Figure 2:
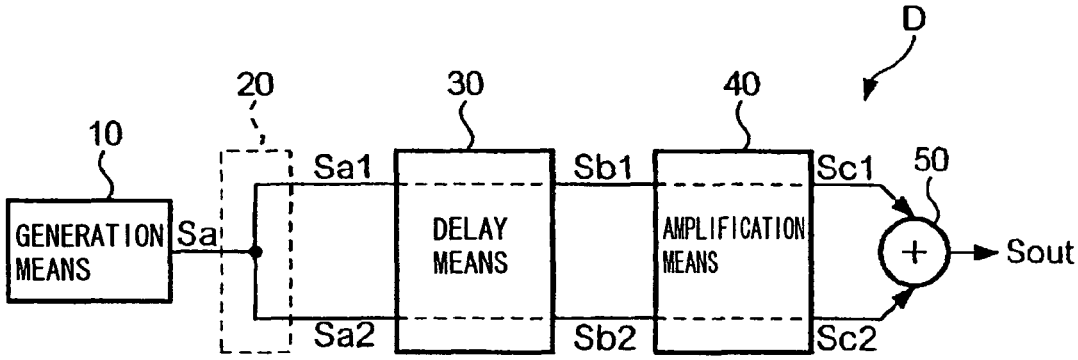
FIG. 2 is a block diagram showing a configuration of an audio signal processing apparatus according to a first embodiment.

First, referring to FIG. 2, a configuration of an audio signal processing apparatus according to a first embodiment of the present invention will be herein explained. This audio signal processing apparatus D is an apparatus for generating the audio signal Sout for expressing the rough or harsh voice as shown in the portion (b) of FIG. 1, and is provided with, as shown in FIG. 2, a generation means 10, a distribution means 20, a delay means 30, an amplification means 40, and an addition means 50. It should be understood that each of the generation means 10, the delay means 30, the amplification means 40, and the addition means 50 might be achieved by hardware, such as a DSP or the like dedicated to the processing of the audio signal, or might be achieved through execution of a program by a processing units, such as a CPU (Central Processing Unit) or the like.

The generation means 10 shown in FIG. 2 is a means for generating an audio signal (namely, a signal of a waveform similar to a waveform of an actual sound wave) Sa of a time domain. More specifically, the generation means 10 generates the audio signal Sa of a waveform shown in a portion (b) of FIG. 3. Meanwhile, in a portion (a) of FIG. 3, a waveform of the audio signal S0 having a pitch P0 (target pitch) equivalent to the audio signal Sout that the audio signal processing apparatus D should generate is represented together for comparison with other audio signal. As shown in the portion (a) of FIG. 1, this audio signal S0 is a signal representing a voice, which is perceived on audibility to be articulate (namely, it is neither a hoarse voice nor the rough or harsh voice). As shown in the portion (b) of FIG. 3, the audio signal Sa that the generation means 10 generates expresses a voice lower than that of the audio signal S0 by one octave. In other words, the generation means 10 generates the audio signal Sa of a pitch Pa (period Ta), which is approximately one-half of the target pitch P0.

The distribution means 20 shown in FIG. 2 is a means for distributing the audio signal Sa generated by the generation means 10 to an audio signal Sa1 of a first channel and an audio signal Sa2 of a second channel. In FIG. 2, there is illustrated a case where the distribution means 20 is achieved by branching a transmission path extended from an output terminal of the generation means 10 to two channels. The audio signals Sa1 and Sa2 are supplied to the delay means 30. This delay means 30 relatively delays the audio signal Sa1 of the first channel relative to the audio signal Sa2 of the second channel, and outputs them as the audio signals Sb1 and Sb2 to the amplification means 40, respectively. The amplification means 40 is a means for appropriately adjusting a gain ratio between the audio signal Sb1 and the audio signal Sb2, and outputting respective signals after this adjustment as audio signals Sc1 and Sc2. The addition means 50 generates an audio signal Sout by adding the audio signal Sc1 of the first channel and the audio signal Sc2 of the second channel outputted from the amplification means 40 to thereby output an added audio signal. This audio signal Sout is sounded as a sound wave after supplied to a sounding apparatus, such as a loudspeaker, an earphone, or the like.

Figure 3:
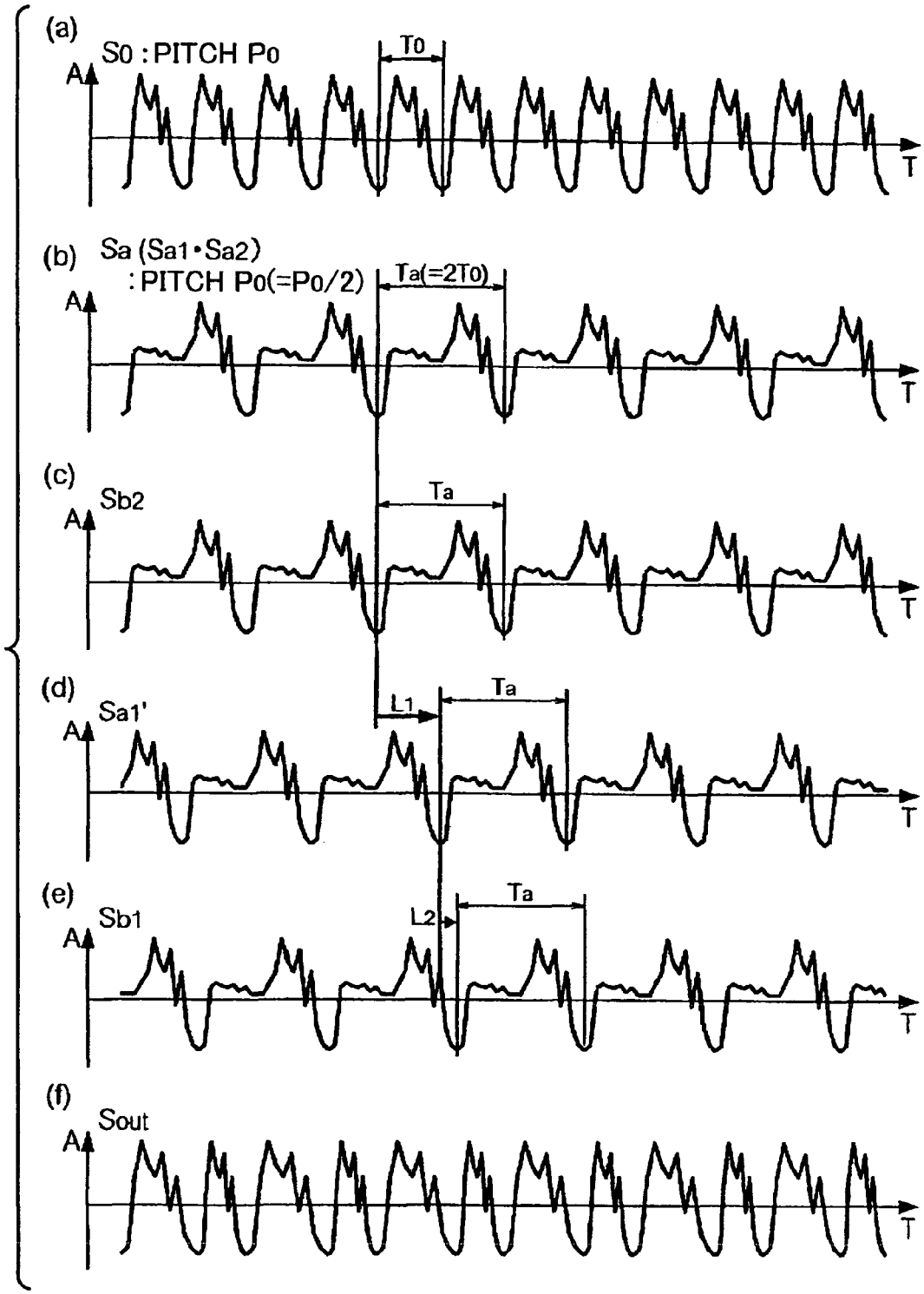
FIG. 3 is a chart showing an audio signal waveform in connection with the processing operation by the audio signal processing apparatus.

Here, in a portion (c) of FIG. 3, the audio signal Sb2 outputted from the delay means 30 is shown, while in a portion (e) of FIG. 3, the audio signal Sb1 outputted from the delay means 30 is shown. In this embodiment, the audio signal Sa1 is delayed relative to the audio signal Sa2 so that a phase difference between the audio signal Sb1 and the audio signal Sb2 may be a phase difference corresponding to an added value (L1+L2) between a duration L1 which is approximately one-half of the period Ta of the audio signal Sa, and a duration L2 shorter than that L1. More specifically, first, by delaying the audio signal Sa1 by the duration L1 which is equal to approximately one-half of the period Ta of the audio signal Sa (namely, the period T0 corresponding to the target pitch P0), the delay means 30 generates the audio signal Sa1' shown in a portion (d) of FIG. 3, and second, by delaying this audio signal Sa1' by the duration L2 shorter than the duration L1, generates the audio signal Sb1 shown in a portion (e) of FIG. 3 Now, supposing that the audio signal Sa1' and the audio signal Sb2 be added, the audio signal Sout generated resulting from the addition will have a waveform in which a large number of unit waveforms U, each having the same period T0 are arranged at even intervals as shown in the portion (a) of FIG. 1, and the portion (a) of FIG. 3. As opposed to this, if the audio signal Sb1 obtained by further delaying the audio signal Sa1' by the duration L2 be added to the audio signal Sb2, as shown in the portion (b) of FIG. 1, and a portion (f) of FIG. 3, the audio signal Sout with the waveform in which respective unit waveforms U (U1 and U2), each having different periods, are alternately arranged on the time base will be generated. As described above, the audio signal Sout having such characteristics is a signal expressing an individual voice which is rich in expression, such as the rough or harsh voice.

As described above, according to the present embodiment, the audio signal Sa of the time domain having the pitch Pa equal to approximately one-half of the target pitch P0 is branched to two channels, and the audio signals Sa1 and Sa2 of respective channels are mutually added after being given the phase difference corresponding to the added value of the duration L1 and the duration L2, so that the audio signal Sout is generated. As will be understood, since the audio signal is processed in the time domain (without divided into a frame), as shown in the portion (b) of FIG. 1, that makes it possible to generate a voice in which the duration of each unit waveform U changes every moment, namely a natural voice close to an actual human being's rough or harsh voice. Hereinafter, a more specific aspect of the audio signal processing apparatus D shown in FIG. 2 will be explained. Incidentally, the same or a similar reference numeral will be given to a portion which serves as the same or a similar function throughout the respective drawings shown below.

(A1: First Aspect)

Figure 4:
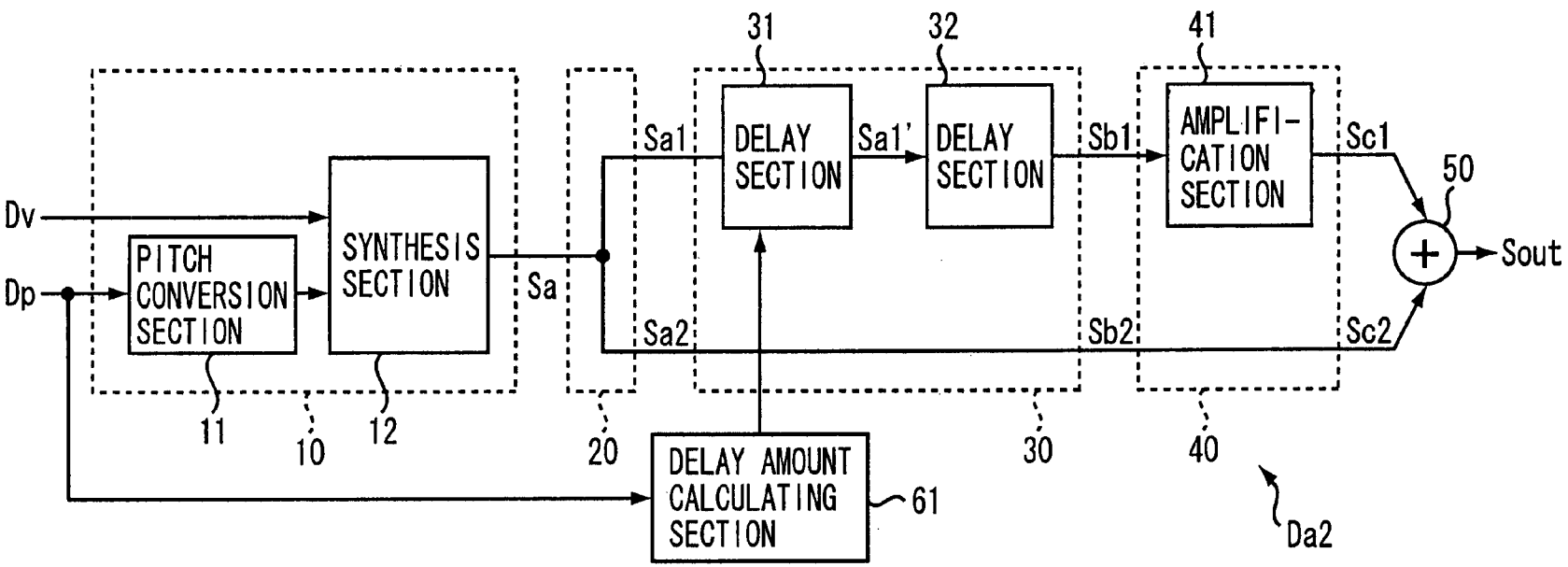
FIG. 4 is a block diagram showing a configuration of an audio signal processing apparatus according to a first aspect of the first embodiment.

FIG. 4 is a block diagram showing a configuration of an audio signal processing apparatus according to a first aspect. The generation means 10 of an audio signal processing apparatus Da1 according to this first aspect is a means for synthesizing the audio signal Sa, by linking voice segments on the basis of pitch data Dp and vocal sound data Dv, which are supplied from an external source. The pitch data Dp is data for specifying a pitch of the audio signal Sout that should be outputted from the audio signal processing apparatus Da1, and the vocal sound data Dv is data for specifying a vocal sound of a voice that the audio signal Sout expresses. For example, when the audio signal processing apparatus Da1 is applied to a singing synthesis apparatus, data for expressing a musical interval (note) of a musical composition are utilized as the pitch data Dp, and data for specifying a character of a lyric are utilized as the vocal sound data Dv.

As shown in FIG. 4, the generation means 10 in this first aspect includes a pitch conversion section 11 and a synthesis section 12. Among these, the pitch conversion section 11 converts the pitch data Dp supplied from the external source into data representing the pitch Pa lower than that by one octave and outputs a converted data to the synthesis section 12. In other words, the pitch conversion section 11 is means for specifying the pitch Pa, which is approximately one-half of the target pitch P0, to the synthesis section 12. Meanwhile, the synthesis section 12 is means for outputting the audio signal Sa, by adjusting the audio signal obtained by linking the voice segments according to the vocal sound data Dv, to the pitch Pa that the pitch data Dp represents. More specifically, the synthesis section 12 includes memory means for storing the voice segment which is a phoneme or a phoneme chain for every vocal sound (a vowel, a consonant, and a combination thereof). The synthesis section 12, first, sequentially selects the voice segment according to the vocal sound data Dv among a large number of voice segments stored in the memory means to thereby link selected voice segments, second, generates the audio signal from an array of these voice segments, and third, generates the audio signal Sa by adjusting the pitch of this audio signal to the pitch Pa that the pitch data Dp represents, to output the audio signal Sa after this adjustment. In the present invention, however, a method for synthesizing the audio signal Sa is not limited to this. The audio signal Sa outputted from the synthesis section 12 is distributed to the audio signals Sa1 and Sa2 of two channels by the distribution means 20.

The delay means 30 according to this first aspect includes a delay section 31 and a delay section 32. Among these, the delay section 31 delays the audio signal Sa1 of the first channel by the duration L1, and outputs the audio signal Sa1'. Meanwhile, the delay section 32 delays the audio signal Sa1' outputted from the delay section 31 by the duration L2, and outputs the audio signal Sb1. The duration L2 in this first aspect is a fixed value defined beforehand. Meanwhile, the duration L1 will be appropriately changed depending on the pitch Pa of the audio signal Sa. A delay amount calculating section 61 shown in FIG. 4 is a means for calculating this duration L1 to set it to the delay section 31. The pitch data Dp is supplied to the delay amount calculating section 61. The delay amount calculating section 61 calculates the period T0 (namely, duration which is approximately one-half of the period Ta of the audio signal Sa) corresponding to the pitch P0 that this pitch data Dp represents, and specifies the period T0 calculated here to the delay section 31 as the duration L1. It should be noted that the audio signal Sa2 of the second channel is supplied to the addition means 50, without being subjected to the delay processing and the amplification processing, but for the convenience sake in explanation, the audio signal Sb2 outputted from the delay means 30 and the audio signal Sc2 outputted from the amplification means 40 are represented by different symbols (similar description will be made hereinbelow).

Meanwhile, the amplification means 40 includes an amplification section 41 arranged corresponding to the first channel. This amplification section 41 amplifies the audio signal Sb1, and outputs the signal after this amplification as the audio signal Sc1. A gain in the amplification section 41 is appropriately changed according to the details of the operation to an input device (for example, a keyboard equipped with the operating element), which is not shown. Here, the more the gain in the amplification section 41 is increased, the more the amplitude of the audio signal Sc1 is increased relative to the amplitude of the audio signal Sc2. Since the characteristics of the rough or harsh voice that the audio signal Sout expresses are significantly influenced by the audio signal Sc1, the further the amplitude of the audio signal Sc1 is increased due to an increase of the gain of the amplification section 41, the further the likeness of the rough or harsh voice of the voice that the audio signal Sout expresses is increased. Thus, by operating the input device appropriately, the user can spontaneously select the characteristics of the voice outputted from the audio signal processing apparatus Da1.

On the basis of the above configuration, the synthesized audio signal Sa is branched to the audio signal Sa1 and the audio signal Sa2 by the generation means 10 (refer to the portion (b) of FIG. 3), and among these, the audio signal Sa1, after being delayed by the added value between the duration L1 which is approximately one-half of the period of the audio signal Sa and the predetermined duration L2, is outputted to the amplification means 40 as the audio signal Sb1 (refer to the portion (e) of FIG. 3). Further, this audio signal Sb1 is adjusted to desired amplitude by the amplification section 41 and outputted as the audio signal Sc1. Meanwhile, the audio signal Sa2 is supplied to the addition means 50 as the audio signal Sc2, without passing through the delay processing and the amplification processing (refer to the portion (c) of FIG. 3). Subsequently, the audio signal Sc1 and the audio signal Sc2 are added by the addition means 50, and the audio signal Sout generated by this addition is outputted as a sound wave from the sounding apparatus.

As described above, according to this first aspect, since the audio signal Sa is synthesized on the basis of the vocal sound data Dv and the pitch data Dp, a singing voice of various musical compositions can be generated as the rough or harsh voice. Moreover, since the delay amount (duration L1) of the delay section 31 is selected according to the pitch data Dp, the various rough or harsh voices according to the pitch (musical interval) of the musical composition can be arbitrarily appropriately generated.

(A2: Second Aspect)

As for the rough or harsh voice, there is a tendency that the louder the voice volume thereof is, the more remarkable the feature on audibility becomes. For example, it is a case that a voice sounded with a small voice volume is not heard to be so dull, but a voice sounded with a large voice volume is heard to be considerably dull. In order to reproduce such a tendency, an audio signal processing apparatus Da2 according to this aspect adjusts a delay amount of the delay section 32 according to a voice volume of the audio signal Sa.

Incidentally, a degree that the voice is heard to be dull (hereinafter, referred to as "degree of the rough or harsh voice") is increased as a difference between the period T1 and the period T2 shown in the portion (b) of FIG. 1 is larger. The larger the difference between the period T1 and the period T2 becomes, the more the phase difference between the audio signal Sc1 of the first channel and the audio signal Sc2 of the second channel comes apart from the duration L1. For example, now, assuming a case where the duration L2 is zero, since the audio signal Sout obtained by the addition between the audio signal Sc1 delayed further than the audio signal Sc2 by the duration L1 corresponding to approximately one-half of the period Ta of the audio signal Sa, and the audio signal Sc2 has a waveform in which the periods T0 of all unit waveforms U are almost the same like the articulate voice shown in the portion (a) of FIG. 1, any feature as the rough or harsh voice is hardly exhibited. Meanwhile, if the duration L2 is being increased, the difference between the period T1 and the period T2 in the audio signal Sout is being gradually increased, so that the degree of the rough or harsh voice of the voice that this audio signal Sout expresses is also being increased. In other words, it may be the that the degree of the rough or harsh voice of the voice outputted from the audio signal processing apparatus Da2 is determined by the delay amount (duration L2) set to the delay section 32. For that reason, according to this embodiment, the duration L2 set to the delay section 32 can be changed according to the voice volume of the audio signal Sa.

Figure 5:
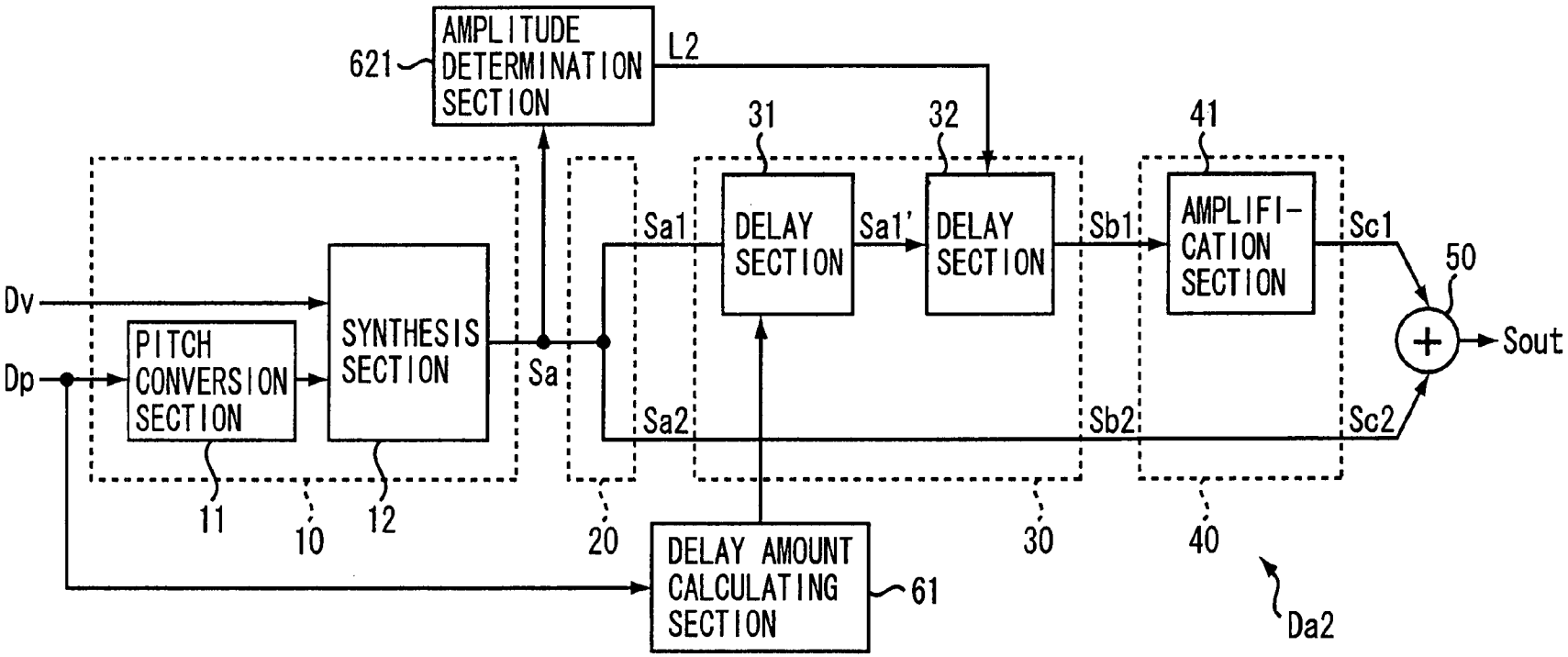
FIG. 5 is a block diagram showing a configuration of an audio signal processing apparatus according to a second aspect of the first embodiment.
Figure 6:
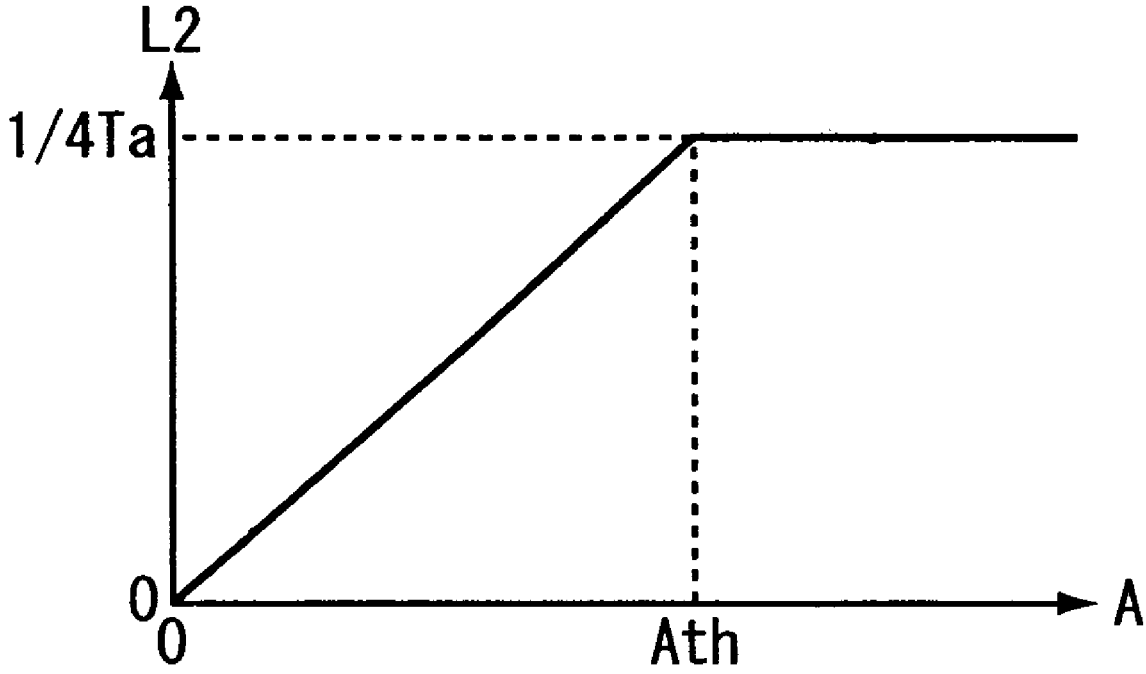
FIG. 6 is a graph showing a relationship between amplitude of the audio signal Sa and a duration L2 in the second aspect of the first embodiment.

FIG. 5 is a block diagram showing a configuration of the audio signal processing apparatus according to this aspect. As shown in FIG. 5, in addition to respective sections shown in FIG. 4, this audio signal processing apparatus Da2 further includes an amplitude determination section 621. The amplitude determination section 621 detects the amplitude (voice volume) of audio signal Sa outputted from the generation means 10 (synthesis section 12), and specifies the duration L2 according to this amplitude in the delay section 32. More specifically, as shown in FIG. 6, the amplitude determination section 621 specifies duration L2, which becomes longer as the amplitude A of the audio signal Sa is larger, to the delay section 32. However, when the duration L2 exceeds "one-fourth" of the period Ta of the audio signal Sa, this time, the difference between the period T1 and the period T2 will be decreased and the degree of the rough or harsh voice will thereby be reduced, so that the amplitude determination section 621 changes the duration L2 specified to the delay section within a range of "0" to "¼ Ta" according to the amplitude A of the audio signal Sa. In other words, as shown in FIG. 6, when the amplitude A of the audio signal Sa exceeds a predetermined threshold Ath, the duration L2 specified to the delay section will be "¼ Ta". As described above, according to this aspect, the larger the amplitude A of the audio signal Sa is, the more the degree of the rough or harsh voice of the audio signal Sout is increased, so that it is possible to reproduce the tendency of the change of the degree of the rough or harsh voice when human being actually sounds. Incidentally, the configuration and operation of those other than the elements for changing the degree of the rough or harsh voice are in common with those of the first aspect.

(A3: Third Aspect)

In the first aspect, the configuration in which the duration L2 set to the delay section 32 has been defined beforehand has been illustrated, while in the second aspect, the configuration in which the duration L2 has been controlled according to the amplitude A of the audio signal Sa has also been illustrated, but a configuration in which the delay amount of the delay means 30 is determined by other elements may be employed. For example, as shown below, a configuration in which the duration L2 of the delay section 32 is determined according to data (hereinafter, referred to "control data") Dc supplied from an external source may also be employed.

Figure 7:
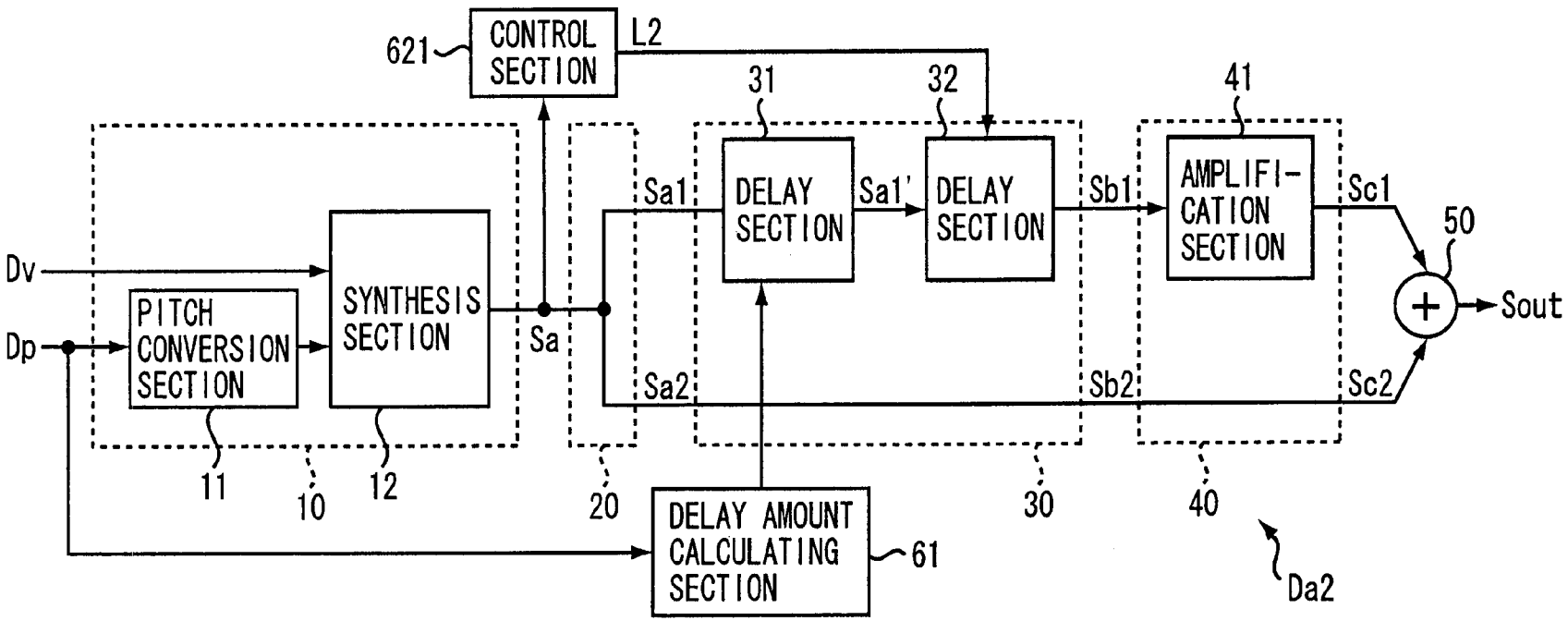
FIG. 7 is a block diagram showing a configuration of an audio signal processing apparatus according to a third aspect of the first embodiment.

FIG. 7 is a block diagram showing a configuration of an audio signal processing apparatus according to this aspect. As shown in FIG. 7, in addition to respective elements shown in FIG. 4, an audio signal processing apparatus Da3 further includes a control section 631. This control section 631 is means for controlling the delay section 32 of the delay means 30 on the basis of the control data Dc supplied from the external source. The control data Dc is data for specifying the delay amount (duration L2) of the delay section 32, and has a data structure in conformity with, for example a MIDI standard. In other words, this control data Dc is the data in which a large number of pairs composed of event data for specifying the duration L2 and timing data for indicating the timing when each event is executed are sequentially arranged. When a timing specified by the timing data arrives, the control section 631 specifies the duration L2 indicated by the event data pairing up with the timing data, to the delay section 32. This delay section 32 delays the audio signal Sa1' supplied from the delay section 31 by the duration L2 specified from the control section 631, and outputs a delayed signal as the audio signal Sb1. Other configuration and operation are similar to those of the first aspect.

As explained in the second aspect, since the degree of the rough or harsh voice of the voice which the audio signal Sout expresses is determined by the duration L2, according to this aspect, the degree of the rough or harsh voice of the audio signal Sout can be changed at an arbitrary timing according to the control data Dc. Moreover, when the audio signal processing apparatus Da3 according to this aspect is applied to, for example the singing synthesis apparatus, if the control data Dc is created so that the duration L2 may be changed at a timing of synchronizing with a performance of a musical composition, that makes it possible to increase attractivity of the singing accompanying the performance of the musical composition.

B: Second Embodiment

Next, an audio signal processing apparatus according to a second embodiment of the present invention will be explained. According to the first embodiment, the configuration in which the gain of the amplification means 40 has been determined according to the operation to the input device has been illustrated. Meanwhile, according to this embodiment, there is employed a configuration in which the delay amount set to the delay means 30 is kept at the duration L1, while the gain of the amplification means 40 is changed as occasion arises with the passage of time. Incidentally, since a configuration of the audio signal processing apparatus D according to this embodiment is similar to that of shown in FIG. 2, throughout the embodiments, the same or a similar reference numeral will be given to an element which serves a function similar to that of the first embodiment, and the description thereof will be omitted appropriately.

(B1: First Aspect)

Figure 8:
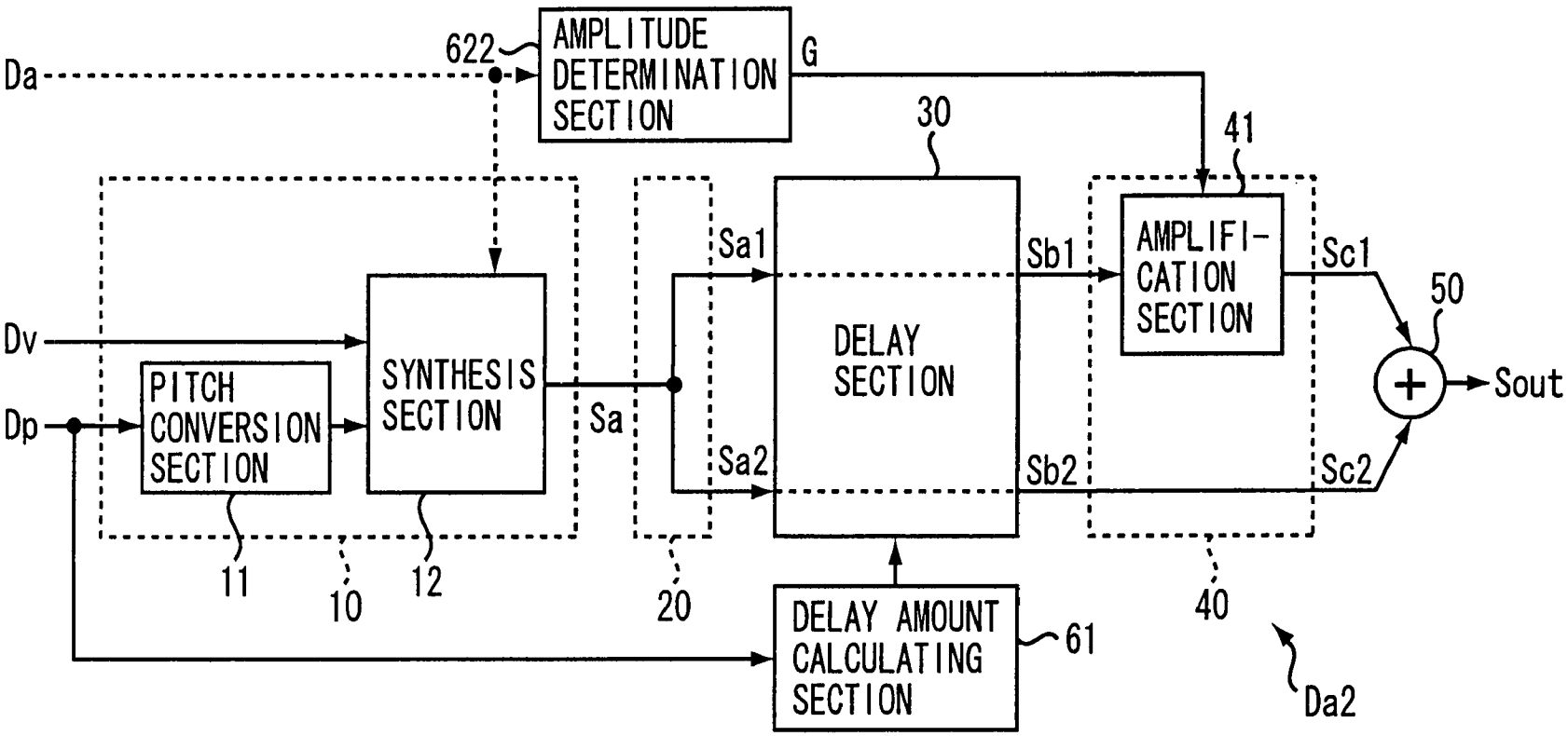
FIG. 8 is a block diagram showing a configuration of an audio signal processing apparatus according to a first aspect of a second embodiment.

FIG. 8 is a block diagram showing a configuration of an audio signal processing apparatus according to a first aspect of this embodiment. As shown in FIG. 8, in addition to respective sections shown in FIG. 4, this audio signal processing apparatus Db1 further includes an amplitude determination section 622. This amplitude determination section 622 is means for detecting the amplitude A (voice volume) of the audio signal Sa outputted from the generation means 10 (synthesis section 12) in a manner similar to that of the amplitude determination section 621 shown in FIG. 5. The amplitude determination section 622 in this aspect, however, controls the gain G of the amplification section 41 according to the amplitude A of the audio signal Sa. More specifically, the amplitude determination section 622 increases the gain G of the amplification section 41 as the amplitude A of the audio signal Sa becomes larger. When the amplitude of the audio signal Sa exceeds a threshold, however, the gain G specified to the amplification section 41 is kept at a predetermined value.

Figure 9:
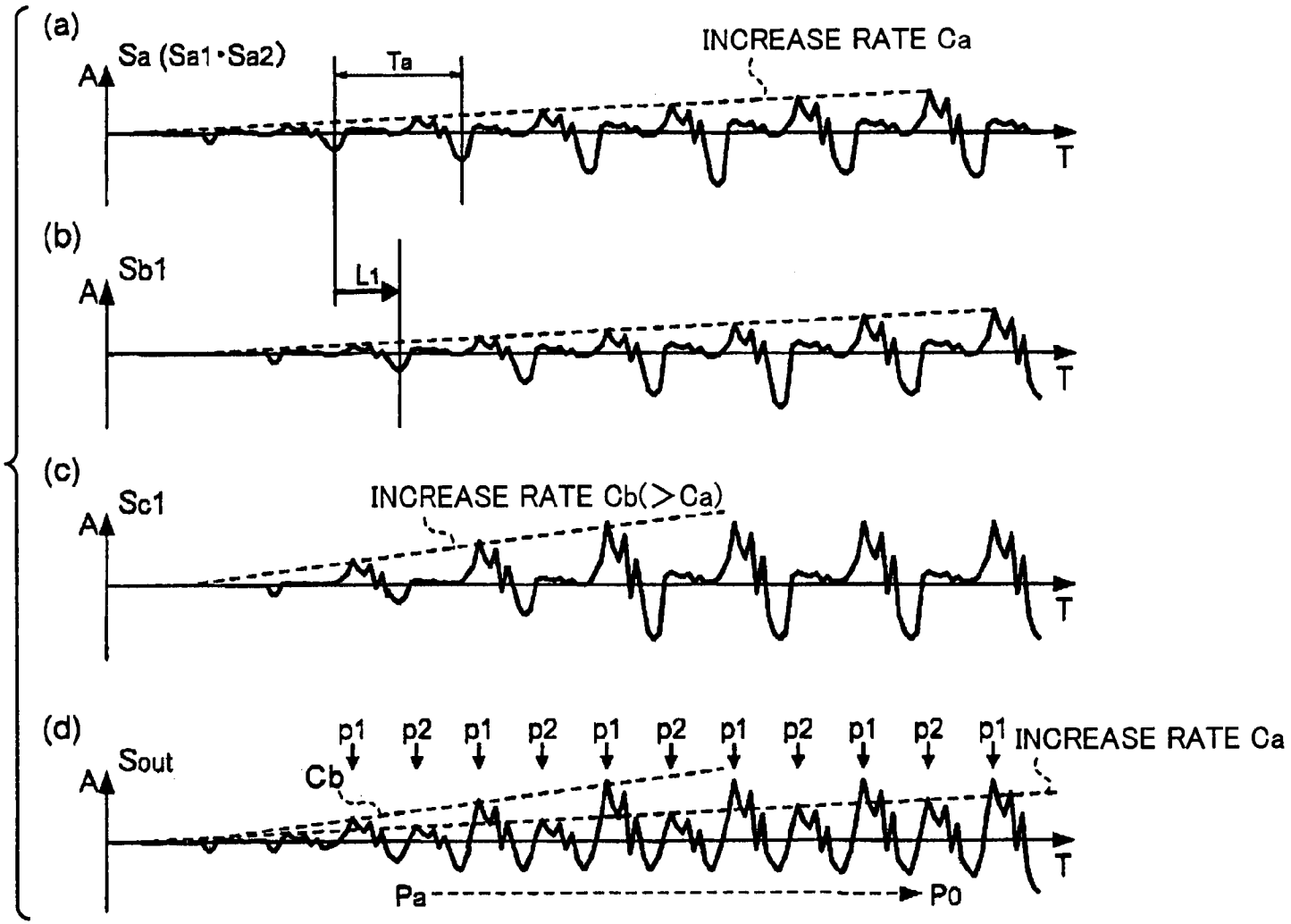
FIG. 9 is a chart showing respective audio signal waveforms according to the first aspect of the second embodiment.

FIG. 9 is a chart showing respective audio signal waveforms in accordance with this aspect. In a portion (a) in FIG. 9, it is assumed a case where the amplitude A of the audio signal Sa is gradually increased with the passage of time. Hereinafter, an increase rate of the amplitude A of the audio signal Sa at this time will be denoted as "Ca". This increase rate Ca is a parameter indicating a degree for the amplitude between unit waveforms U which successively appear frontward and backward on the time base to be changed, and more specifically, is a slope of a line connecting between peaks of respective unit waveforms U. As shown in a portion (b) of FIG. 9, the delay means 30 outputs the audio signal Sb1 by delaying this audio signal Sa by the duration L1 corresponding to approximately one-half of the period Ta.

Meanwhile, the amplification section 41 of the amplification means 40 outputs, on the basis of the control by the amplitude determination section 622, the audio signal Sc1 by amplifying the audio signal Sb1 by the gain G according to the amplitude A of the audio signal Sa. Here, as shown in a portion (c) of FIG. 9, the amplitude determination section 622 changes the gain G specified to the amplification section 41 according to the amplitude A of the audio signal Sa so that an increase rate Cb of the amplitude of the audio signal Sc1 (namely, the slope of the line connecting between the peaks of respective unit waveforms U of the audio signal Sc1) may be larger than the rate of increase Ca of the amplitude A of the audio signal Sa. Meanwhile, the audio signal Sa2 is supplied to the addition means 50 as the audio signal Sc2, while keeping the waveform as it is. As a result, the amplitude of the peak in each unit waveform U of the audio signal Sc1 becomes larger than that of the audio signal Sc2 which appears in front of the audio signal Sc1 by the duration L1.

In a portion (d) of FIG. 9, the waveform of the audio signal Sout generated by adding the audio signal Sc1 and the audio signal Sc2 is shown. As shown in portion (d) of FIG. 9, this audio signal Sout results in a waveform in which a peak p2 corresponding to the audio signal Sc2 (=Sa2) and a peak p1 corresponding to the audio signal Sc1 appear alternately for every duration (period T0) which is approximately one-half of the period Ta. Among these, the amplitude of each peak p2 corresponding to the audio signal Sc2 increases at the increase rate Ca with the passage of time. Meanwhile, the amplitude of each peak p1 corresponding to the audio signal Sc1 increases at the increase rate Cb larger than the increase rate Ca with the passage of time. At a step where the audio signal Sa begins to increase (namely, at a step on the left-hand side in FIG. 9), since the amplitude of the peak p1 which increases at the increase rate Cb is sufficiently larger as compared with that of the peak p2, the voice sounded from the sounding apparatus on the basis of this audio signal Sout is perceived as a voice of the pitch Pa for the user. Meanwhile, since the amplitude of the peak p2 approaches the amplitude of the peak p1 when the amplitude of the audio signal Sa increases, the pitch of the voice sounded from the sounding apparatus gradually approaches the pitch P0, and finally, the amplitude of the peak p1 and the amplitude of the peak p2 are coincident, resulting in a waveform equivalent to that of the audio signal S0 of the pitch P0 shown in the portion (a) of FIG. 1. As will be understood, by gradually increasing the gain G of the amplification section 41 according to the amplitude A of the audio signal Sa as this aspect, it is possible to generate the voice which gradually approaches from the voice (pitch pa) lower than the voice of the target pitch P0 by one octave to the pitch P0.

Incidentally, the configuration of detecting the amplitude A from the audio signal Sa is illustrated here, but a configuration of specifying the amplitude by obtaining data for specifying the amplitude A of the audio signal Sa from an external source may be employed. For example, as shown by the broken lines in FIG. 8, in a configuration in which the synthesis section 12 of the generation means 10 receives the voice volume data Da for specifying the amplitude A of the audio signal Sa from the external source to synthesize the audio signal Sa of the amplitude A in question, it may be configured in such a way that on the basis of the amplitude A specified by this voice volume data Da, the amplitude determination section 622 controls the gain G of the amplification section 41. In addition, in this case, the waveform of each audio signal Sout results in a shape shown in FIG. 9(*d*).

(B2: Second Aspect)

In the first aspect, the configuration in which the gain G of the amplification means 40 has been controlled according to the amplitude A of the audio signal Sa has been illustrated. Meanwhile, in this aspect, it has a configuration that the gain of the amplification means 40 is controlled according to the data supplied from the external source.

Figure 10:
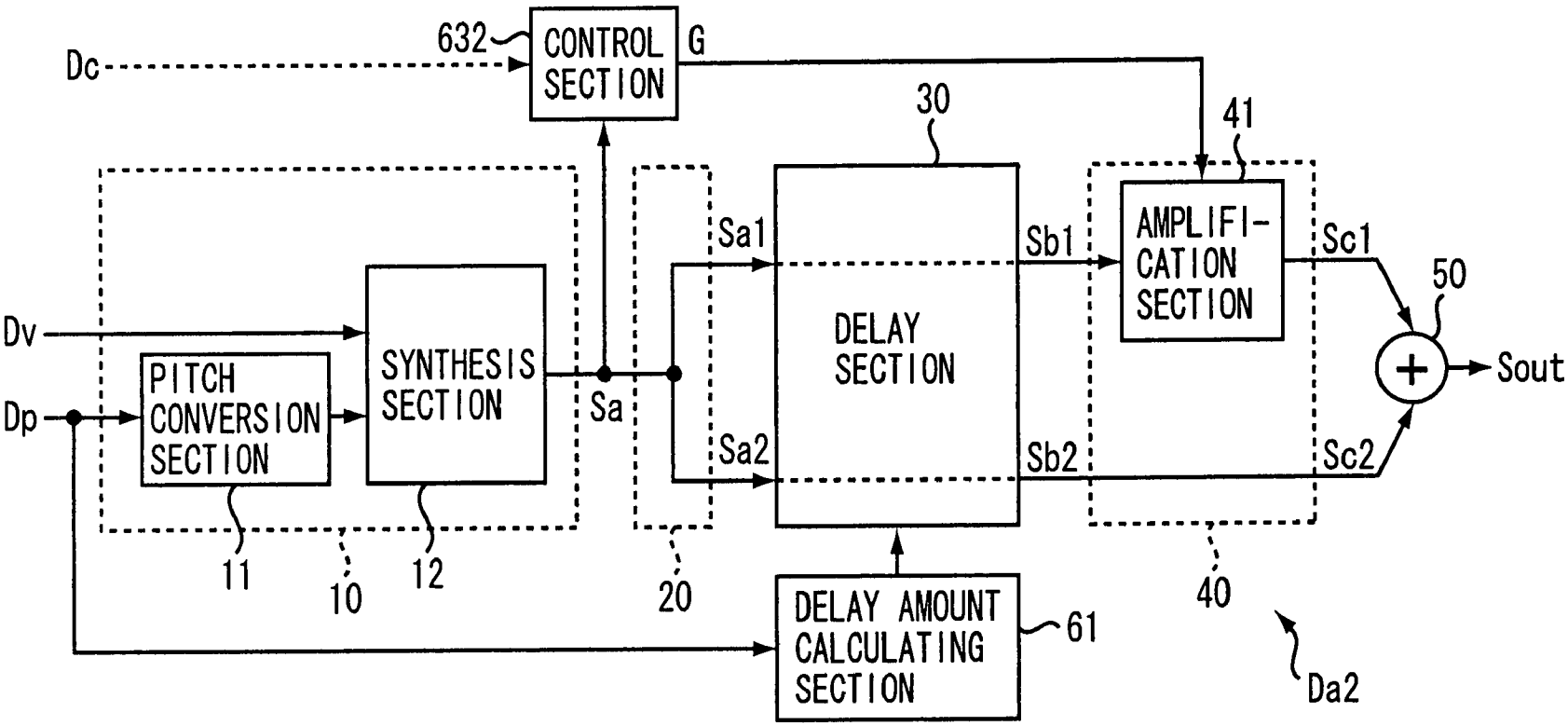
FIG. 10 is a block diagram showing a configuration of an audio signal processing apparatus according to a second aspect of the second embodiment.

FIG. 10 is a block diagram showing a configuration of an audio signal processing apparatus according to this aspect. As shown in FIG. 10, in addition to respective elements shown in FIG. 4, an audio signal processing apparatus Db2 further includes a control section 632. This control section 632 is means for controlling the amplification section 41 of the amplification means 40 on the basis of the control data Dc supplied from the external source. The control data Dc is data for specifying the gain G of the amplification section 41, and has a data structure in conformity with, for example the MIDI standard. In other words, this control data DC is the data in which a large number of pairs composed of event data for specifying the gain G and timing data for indicating the timing of each even are arranged. When a timing specified by the timing data arrives, the control section 632 specifies the gain G indicated by the event data pairing up with the timing data, to the amplification section 41. In this aspect, it is assumed a case where the control data Dc is generated so that the gain specified to the amplification section 41 may gradually increase from "0" to "1" with the passage of time.

Figure 11:
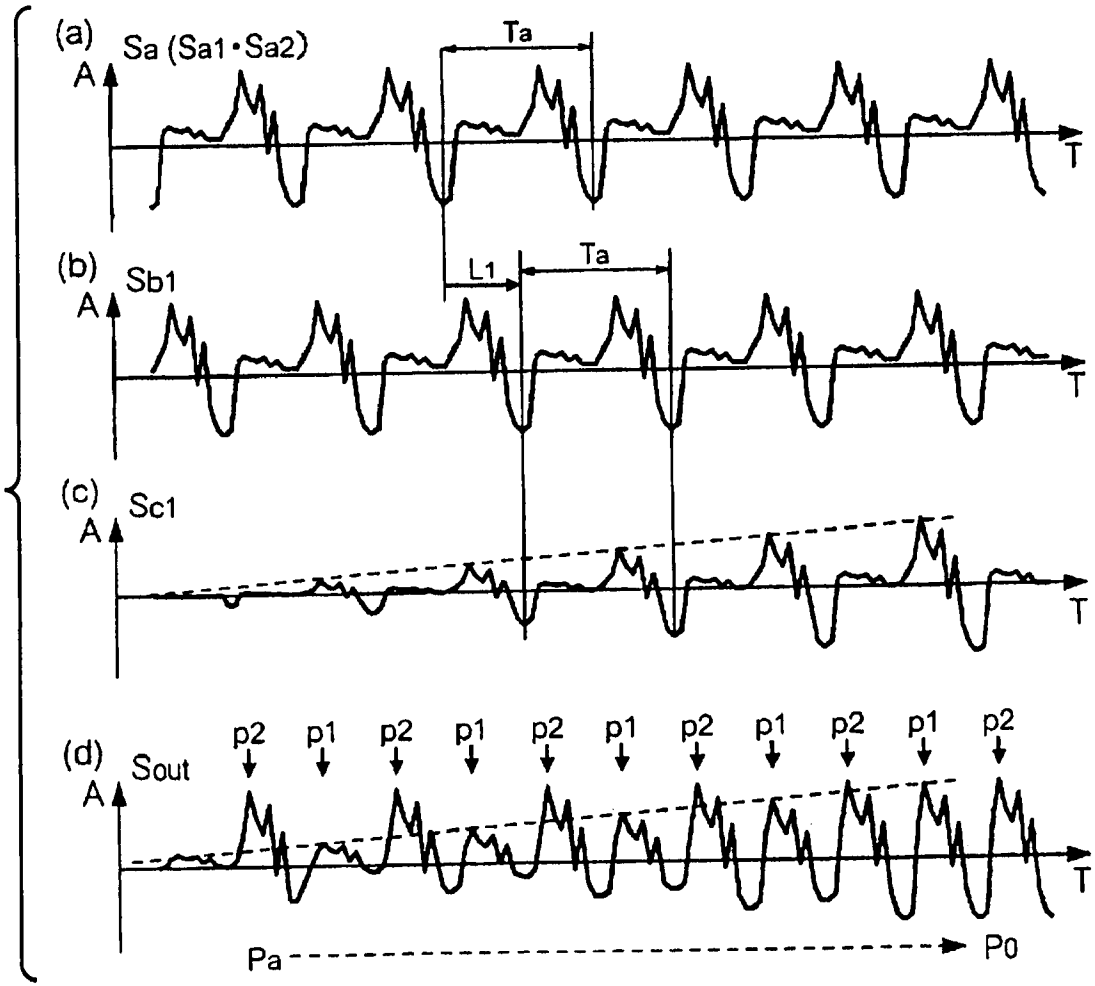
FIG. 11 is a chart showing respective audio signal waveforms according to the second aspect of the second embodiment.

FIG. 11 is a chart showing respective audio signal waveforms in accordance with this aspect. As shown in a portion (a) of FIG. 11, this aspect is similar to the first embodiment in that the audio signal Sa of the pitch Pa generated by the generation means 10 is branched to two channels. In this aspect, the audio signal Sa2 of the second channel is supplied to the addition means 50 as the audio signal Sc2, while keeping the waveform as it is. In addition, as shown in a portion (b) of FIG. 11, the audio signal Sa1 of the first channel is delayed by the delay means 30 by the duration L1 and supplied to the amplification section 41 as the audio signal Sb1. Meanwhile, according to the control data Dc, the control section 632 increases the gain specified to the amplification section 41 from "0" to "1" with the passage of time. Consequently, as shown in a portion (c) of FIG. 11, the audio signal Sc1 outputted from the amplification section 41 will be a waveform in which the amplitude A increases with the passage of time, and finally reaches to an amplitude approximately equal to the audio signal Sc2.

In a portion (d) of FIG. 11, the waveform of the audio signal Sout generated by adding the audio signal Sc1 and the audio signal Sc2 is shown. As shown in FIG. 11, this audio signal Sout results in a waveform in which the peak p2 corresponding to the audio signal Sc2 (namely, the audio signal Sa) and the peak p1 corresponding to the audio signal Sc1 appear alternately for every duration (period T0) which is approximately one-half of the period Ta. The amplitude A of each peak p2 corresponding to the audio signal Sc2 is kept at approximately constant (the amplitude of the audio signal Sa). Meanwhile, the amplitude A of each peak p1 corresponding to the audio signal Sc1 is gradually increased with the passage of time according to the control data Dc. Consequently, the voice sounded from the sounding apparatus on the basis of the audio signal Sout is the pitch Pa (namely, the pitch lower than the target pitch P0 by one octave) at the point of time of the left in FIG. 11, and the pitch gradually increases with the passage of time, resulting in a voice which finally reaches the pitch P0. As will be understood, effects similar to the first aspect may be still achieved by this aspect. Moreover, according to this aspect, since the amplitude of the audio signal Sc1 is controlled according to the control data Dc regardless of the audio signal Sa, if the amplitude of the audio signal Sa is sufficiently secured, even when the control data Dc indicates the gain "0", the voice of the pitch Pa can be clearly sounded.

C: Modified Embodiment

Various modifications may be added to each of the embodiments. Specific modified aspects will be provided below. Incidentally, following each aspect may be appropriately combined.

(1) Each aspect of the first embodiment and each aspect of the second embodiment may be combined. For example, in the second embodiment, the configuration in which the delay amount of the delay means 30 is set as the duration L1 has been illustrated, but in a manner similar to that of the first embodiment, a configuration in which the added value between the duration L1 and the duration L2 is set as the delay amount by the delay means 30 may be employed. The duration L2 in this configuration may be set according to the operation to the input device like the configuration shown in FIG. 4, may be set according to the amplitude of the audio signal Sa like the configuration shown in FIG. 5, or may be set according to the control data Dc like the configuration shown in FIG. 7. Moreover, for example, it may be configured in such a way that, by combining the aspects shown in FIG. 5 and FIG. 8, the amplitude determination section 62 (the means having both of the function of the amplitude determination section 621 and the function of the amplitude determination section 622) controls the duration L2 of the delay section 32, and the gain G of the amplification section 41 according to the amplitude A of the audio signal Sa. Moreover, it may be configured in such a way that, by combining the aspects shown in FIG. 7 and FIG. 10, the control section 63 (the means having both of the function of the control section 631 and the function of the control section 632) received the control data Dc for specifying both of the duration L2 and the gain G specifies the gain G to the amplification section 41, while specifying this duration L2 to the delay section 32.

Figure 12:
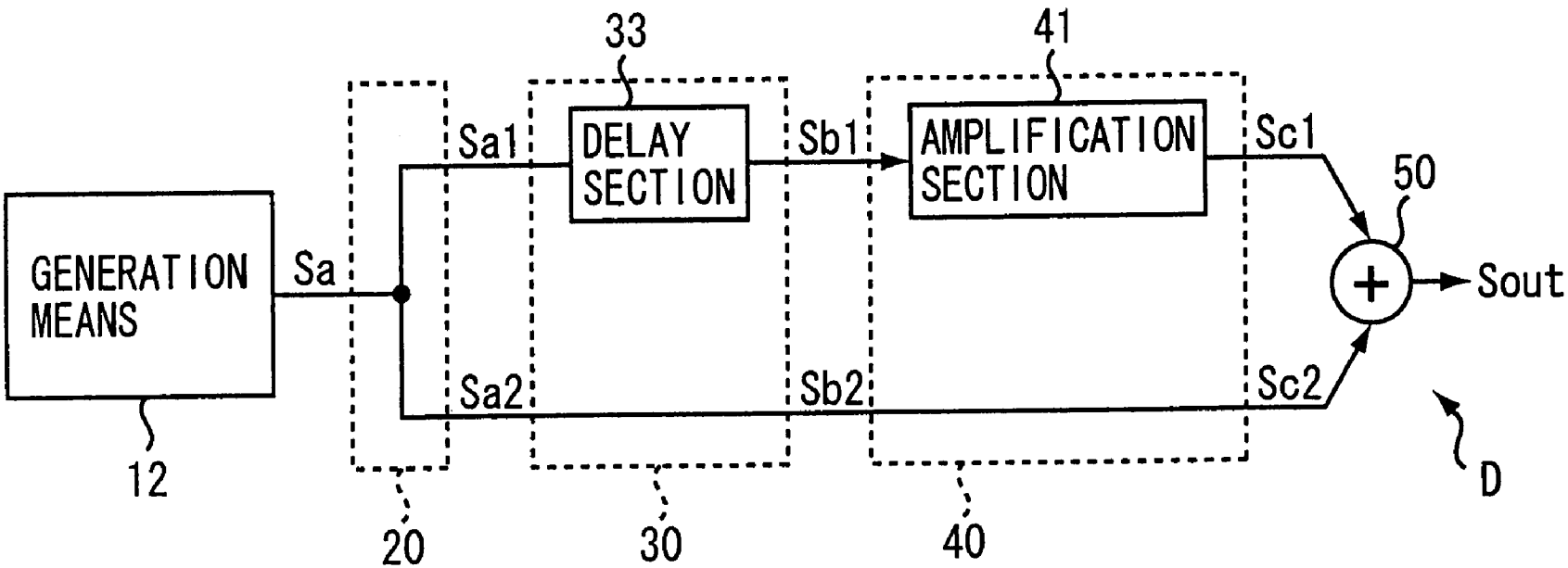
FIG. 12 is a block diagram showing a configuration of an audio signal processing apparatus according to a modified embodiment.
Figure 13:
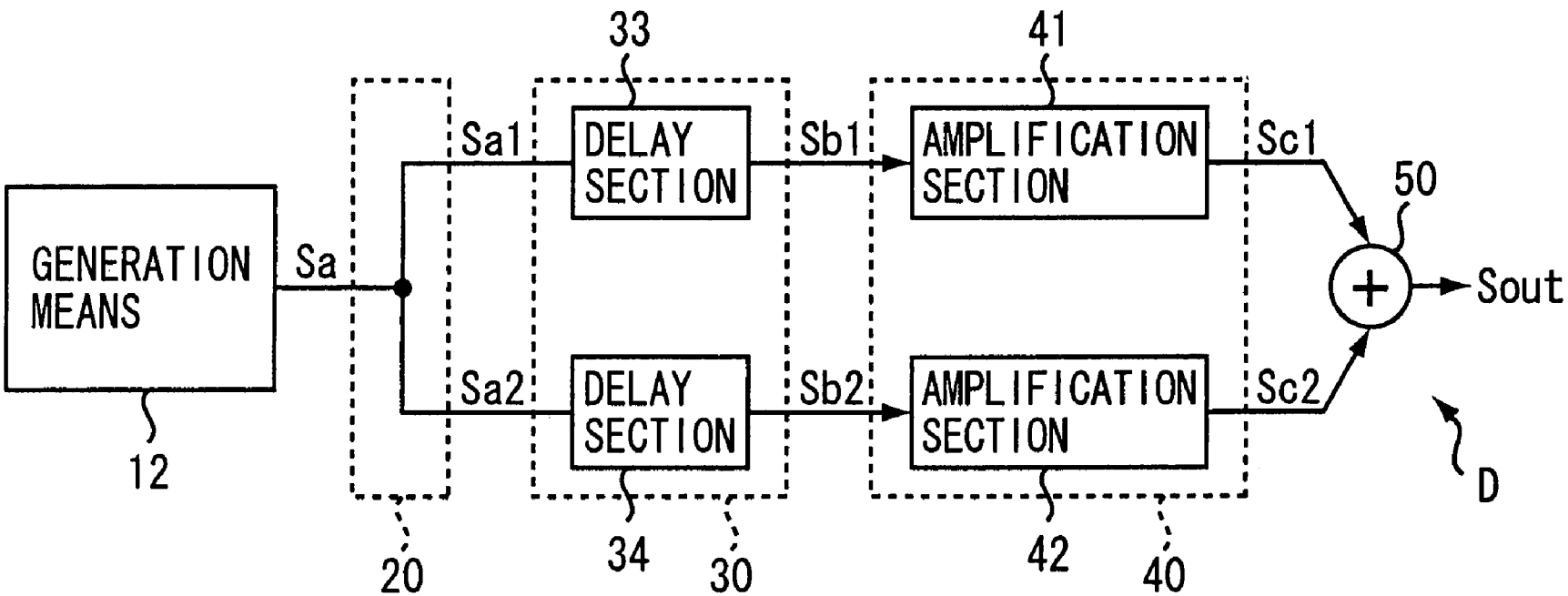
FIG. 13 is a block diagram showing a configuration of an audio signal processing apparatus according to another modified embodiment.

(2) In each embodiment, the configuration in which the delay means 30 has included the delay section 31 and the delay section 32 has been illustrated, but as shown in FIG. 12, a configuration in which the delay means 30 includes only one delay section 33 may be employed. In addition, in this configuration, if it is configured in such a way that the delay amount calculating section 61 calculates the duration L1 according to the pitch data Dp supplied from the external source, and specifies the added value between this duration L1 and the predetermined duration L2 as the delay amount to the delay section 33, a functions similar to that of the first embodiment may be obtained. Additionally, in FIG. 12, the configuration of arranging the delay section 33 and the amplification section 41 so as to correspond to the first channel has been illustrated, but as shown in FIG. 13, a configuration of arranging similar delay section 34 and amplification section 42 so as to correspond to the second channel may be employed. In short, in this aspect, a configuration in which at least either of the audio signals Sa1 and Sa2 is relatively delayed to the other so that the phase difference between the audio signal Sc1 of the first channel and the audio signal Sc2 of the second channel may be the phase difference corresponding to the added value of the duration L1 and the duration L2, or, a configuration in which at least either of the audio signals Sb1 and Sb2 is amplified so that the gain ratio between the audio signal Sc1 of the first channel and the audio signal Sc2 of the second channel may be a desired value is sufficient for this aspect, so that a configuration how to achieve the delay and amplification to each audio signal will be unquestioned.

Figure 14:
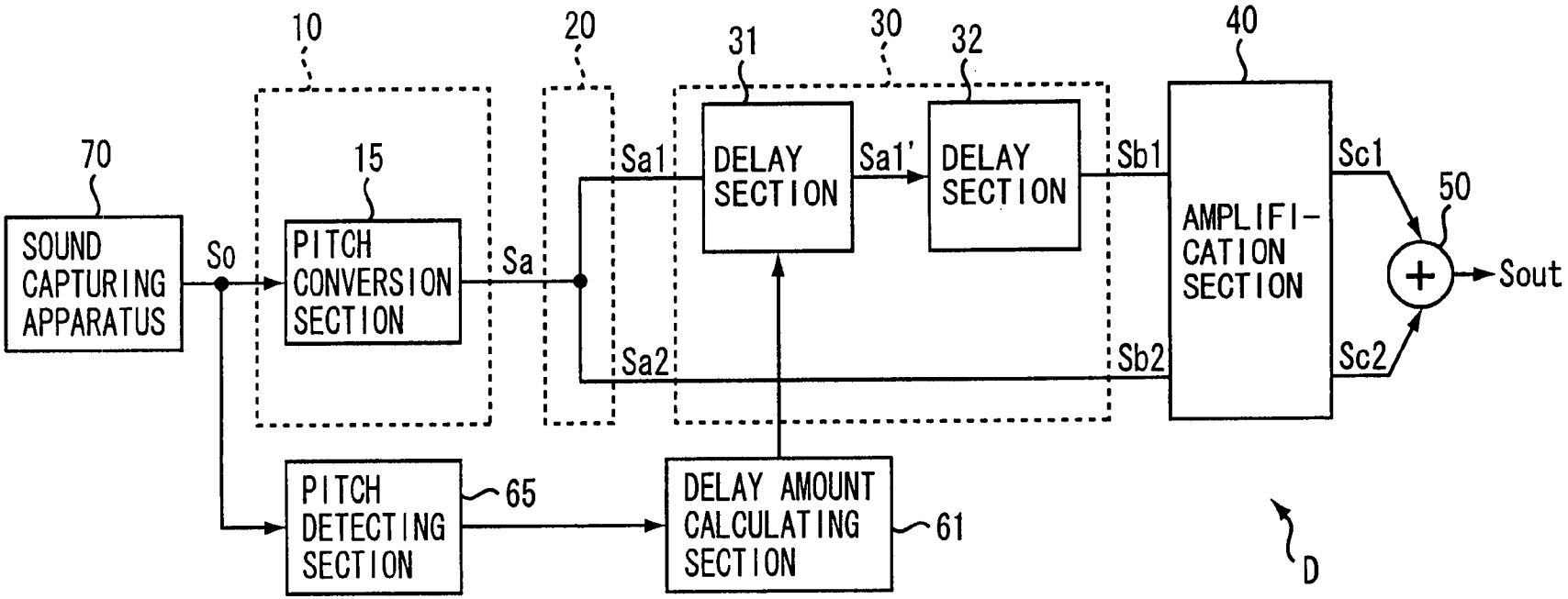
FIG. 14 is a block diagram showing a configuration of an audio signal processing apparatus according to still another modified embodiment.

(3) In each embodiment, the configuration in which the synthesis section 12 has synthesized the audio signal Sa from the voice segments has been illustrated, but as an alternative to this configuration, or with this configuration, a configuration in which the audio signal Sa is generated according to the voice that the user actually sounds may be employed. FIG. 14 is a block diagram showing a configuration of the audio signal processing apparatus D according to this modified embodiment. A sound capturing apparatus 70 shown in FIG. 14 is a means (for example, microphone) for capturing the voice sounded by the user to output the audio signal S0 according to this voice. The audio signal S0 outputted from this sound capturing apparatus 70 is supplied to the generation means 10 and a pitch detecting section 65. When the user sounds the articulate voice different from the rough or harsh voice, the waveform of the audio signal S0 will results in a shape shown in the portion (a) of FIG. 1, and the portion (a) of FIG. 3.

As shown in FIG. 14, the generation means 10 according to this modified embodiment further includes a pitch conversion section 15. This pitch conversion section 15 is a means for converting the pitch P0 of the audio signal S0 supplied from the sound capturing apparatus 70 to the audio signal Sa (namely, the signal expressing the voice lower than the voice expressed by the audio signal S0 by one octave) of that pitch Pa which is approximately one-half of the pitch P0, to output the audio signal Sa. Accordingly, the waveform of the audio signal Sa outputted from the pitch conversion section 15 will result in a shape thereof shown in the portion (b) of FIG. 3. As the method for shifting the pitch P0 of the audio signal S0, well-known various methods may be employed.

Meanwhile, the pitch detecting section 65 is a means for detecting the pitch P0 of the audio signal S0 supplied from the sound capturing apparatus 70 to notify this detected pitch P0 to the delay amount calculating section 61. In a manner similar to that of the first aspect, the delay amount calculating section 61 calculates the period T0 (namely, the duration which is approximately one-half of the period Ta of the audio signal Sa) corresponding to the pitch P0, and specifies this period T0 as duration L1 to the delay section 31. Other configuration is common with that of the first aspect. According to this modified embodiment, since the voice sounded by the user can be converted to the rough or harsh voice and output it, a new attractivity may be provided by applying it to, for example a karaoke apparatus or the like. Incidentally, in the configuration shown in FIG. 14, it may be configured in such a way that after the audio signal Sout outputted from the addition means 50 is added to the audio signal S0 outputted from the sound capturing apparatus 70, it is outputted from the sounding apparatus as the sound wave. According to this configuration, since the rough or harsh voice generated from that voice is sounded with the user's voice, attractivity can be further increased.

Moreover, the audio signal Sa used as a base for generating the audio signal Sout may be prepared in advance. That is, it may be configured in such a way that the audio signal Sa is stored in the memory means (not shown) in advance, this audio signal Sa is sequentially read to be supplied to the distribution means 20. As will be understood, according to the present invention, generating only the audio signal Sa for expressing the voice will be sufficient for this configuration, and a method how to generate it is unquestioned.

(4) In the first embodiment, the configuration in which the duration corresponding to the added value between the duration L1 and the duration L2 has been set as the delay amount by the delay means 30 has been illustrated, but even when the delay amount set to this delay means 30 is set as the duration corresponding to a difference value (L1-L2) between the duration L1 and the duration L2, a functions similar to that of the first embodiment may be achieved.

(5) In each embodiment, the configuration in which the amplification means 40 has been arranged in a subsequent stage of the delay means 30 has been illustrated, but this arrangement may be reversed. Concretely, there may be employed such a configuration that while the amplification means 40 appropriately amplifies the audio signal Sa1 and the audio signal Sa2 outputted from the distribution means 20, and outputs them as the audio signals Sb1 and Sb2, the delay means 30 delays the audio signals Sb1 and Sb2 outputted from the amplification means 40, and outputs the audio signal Sc1 and Sc2.

What is claimed is:

1. An audio signal processing apparatus comprising:

a generation section that generates an audio signal representing a voice, the generation section comprising a pitch conversion section and a synthesis section, the pitch conversion section specifying a pitch which is approximately one-half of a target pitch of a selected audio signal representing an articulate voice to the synthesis section, the synthesis section synthesizing a signal obtained by linking voice segments according to vocal sound data representing the voice, and outputting the audio signal by adjusting a pitch of the synthesized signal to the specified pitch;

a distribution section that distributes the audio signal generated by the generation section to a first channel and a second channel, respectively;

a delay section that delays the audio signal of the first channel relative to the audio signal of the second channel for creating a phase difference between the audio signal of the first channel and the audio signal of the second channel such that the created phase difference has a duration corresponding to either an added value of a first duration which is approximately one half of a period of the audio signal generated by the generation section and a second duration which is set shorter than the first duration and which is a fixed value, or a difference value of the first duration and the second duration;

an addition section that adds the audio signal of the first channel and the audio signal of the second channel with one another, between which the phase difference is created by the delay section, and that outputs the added audio signal having the target pitch; and a delay amount calculation section that sets the first duration of the delay section such that the first duration corresponds to a period defining the target pitch of the added audio signal to be outputted, wherein the output audio signal having the target pitch simulates a rough or harsh voice.

2. The audio signal processing apparatus according to claim 1, further comprising a control section that receives data for specifying the second duration and that sets the second duration to the delay section in accordance with the received data for specifying the second duration.

3. The audio signal processing apparatus according to claim 1, further comprising an amplification section that adjusts a gain ratio between the audio signal of the first channel and the audio signal of the second channel, wherein the addition section adds the audio signal of the first channel and the audio signal of the second channel with one another after the gain ratio therebetween is adjusted by the amplification section.

4. An audio signal processing apparatus comprising:

a generation section that generates an audio signal representing a voice the generation section comprising a pitch conversion section and a synthesis section, the pitch conversion section specifying a pitch which is approximately one-half of a target pitch of a selected audio signal representing an articulate voice to the synthesis section, the synthesis section synthesizing a signal obtained by linking voice segments according to vocal sound data representing the voice, and outputting the audio signal by adjusting a pitch of the synthesized signal to the specified pitch;

a distribution section that distributes the audio signal generated by the generation section to a first channel and a second channel, respectively;

a delay section that delays the audio signal of the first channel relative to the audio signal of the second channel so as to create a phase difference between the audio signal of the first channel and the audio signal of the second channel, such that the created phase difference has a duration which is approximately one-half of a period of the audio signal generated by the generation section;

an amplification section that varies an amplitude of the audio signal of the first channel along a time axis; and an addition section that adds the audio signal of the first channel subjected to processing by the delay section and the amplification section and the audio signal of the second channel with one another, and that outputs the added audio signal having the target pitch; and delay amount calculation section that sets the duration of the phase difference of the delay section such that duration corresponds to a period defining the target pitch of the added audio signal to be outputted, wherein the output audio signal having the target pitch simulates a rough or harsh voice.

5. The audio signal processing apparatus according to claim 4, wherein the delay section delays the audio signal of the first channel relative to the audio signal of the second channel such that the created phase difference has a duration corresponding to either an added value of a first duration which is one-half of the period of the audio signal generated by the generation section and a second duration which is set shorter than the first duration, or a difference value of the first duration and the second duration.

6. The audio signal processing apparatus according to claim 4, further comprising an amplitude determination section that determines an amplitude of the audio signal generated by the generation section, and wherein the amplification section changes the amplitude of the audio signal of the first channel on the basis of the amplitude determined by the amplitude determination section.

7. The audio signal processing apparatus according to claim 4, further comprising a control section that receives data for specifying a gain of the amplification section and that sets the gain of the amplification section according to the received data for specifying the gain of the amplification section.

8. A non-transitory machine readable medium containing a program executable by a computer to perform an audio signal processing method comprising:

a generation process of generating an audio signal representing a voice and providing the generated audio signal to a first channel and a second channel generation process comprising a pitch conversion process specifying a pitch which is approximately one-half of a target pitch of a selected audio signal representing an articulate voice to the synthesis process of synthesizing a signal obtained by linking voice segments according to vocal sound data representing the voice and outputting the audio signal by adjusting a pitch of the synthesized signal to the specified pitch;

a delay process of delaying the audio signal of the first channel relative to the audio signal of the second channel for creating a phase difference between the audio signal of the first channel and the audio signal of the second channel such that the created phase difference has a duration corresponding to either an added value of a first duration which is approximately one half of a period of the generated audio signal and a second duration which is set shorter than the first duration, and which is a fixed value, or a difference value of the first duration and the second duration;

an addition process of adding the audio signal of the first channel and the audio signal of the second channel with one another, between which the phase difference is created, and outputting the added audio signal having the target pitch; and delay amount calculation section that setting the first duration of the delay process such that the first duration corresponds to a period defining the target pitch of the added audio signal to be outputted, wherein the output audio signal having the target pitch simulates a rough or harsh voice.

9. A non-transitory machine readable medium containing a program executable by a computer to perform an audio processing method comprising:

a generation process of generating an audio signal representing a voice and providing the generated audio signal to a first channel and a second channel generation process comprising a pitch conversion process specifying a pitch which is approximately one-half of a target pitch of a selected audio signal representing an articulate voice to the synthesis process of synthesizing a signal obtained by linking voice segments according to vocal sound data representing the voice and outputting the audio signal by adjusting a pitch of the synthesized signal to the specified pitch;

a delay process of delaying the audio signal of the first channel relative to the audio signal of the second channel so as to create a phase difference between the audio signal of the first channel and the audio signal of the second channel, such that the created phase difference has a duration which is approximately one-half of a period of the generated audio signal;

an amplification process of varying an amplitude of the audio signal of the first channel along a time axis; and an addition process of adding the audio signal of the first channel subjected to the delay process and the amplification process and the audio signal of the second channel with one another, and outputting the added audio signal having the target pitch; and delay amount calculation process of setting the duration of the phase difference of the delay section such that duration corresponds to a period defining the target pitch of the added audio signal to be outputted, wherein the output audio signal having the target pitch simulates a rough or harsh voice.

10. An audio signal processing method comprising:

a generation an audio signal representing a voice and providing the generated audio signal to a first channel and a second channel generation the audio signal comprising specifying a pitch which is approximately one-half of a target pitch of a selected audio signal representing an articulate voice synthesizing a signal obtained by linking voice segments according to vocal sound data representing the voice, and outputting the audio signal by adjusting a pitch of the synthesized signal to the specified pitch;

a delay audio signal of the first channel relative to the audio signal of the second channel for creating a phase difference between the audio signal of the first channel and the audio signal of the second channel, such that the created phase difference has a duration corresponding to either an added value of a first duration which is approximately one half of a period of the generated audio signal and a second duration which is set shorter than the first duration and which is a fixed value, or a difference value of the first duration and the second duration;

adding the audio signal of the first channel and the audio signal of the second channel with one another, between which the phrase difference is created, and outputting the added audio signal having the target pitch; and setting the first duration such that the first duration corresponds to a period defining the target pitch of the added audio signal to be outputted, wherein the output audio signal having the target pitch simulates a rough or harsh voice.

11. An audio processing method comprising:

generation an audio signal representing a voice and providing the generated audio signal to a first channel and a second channel, generation the audio signal further comprising specifying a pitch which is approximately one-half of a target pitch of a selected audio signal representing an articulate voice, synthesizing a signal obtained by linking voice segments according to vocal sound data representing the voice, and outputting the audio signal by adjusting a pitch of the synthesized signal to the specified pitch;

a delay audio signal of the first channel relative to the audio signal of the second channel so as to create a phase difference between the audio signal of the first channel and the audio signal of the second channel, such that the created phase difference has a duration which is approximately one half of a period of the generated audio signal:

varying an amplitude of the audio signal of the first channel along a time axis;

adding the audio signal of the first channel subjected to the delay process and the amplification process and the audio signal of the second channel with one another, and outputting the added audio signal having the target pitch; and setting the duration of the created phase difference such that duration corresponds to a period defining the target pitch of the added audio signal to be outputted, wherein the output audio signal having the target pitch simulates a rough or harsh voice.

* * * * *